US005393148A

United States Patent [19]

Berson

[11] Patent Number: 5,393,148

[45] Date of Patent: Feb. 28, 1995

[54] POSTAGE DISPENSING APPARATUS HAVING A THERMAL PRINTER AND METHOD OF USING THE SAME

[75] Inventor: William Berson, Westport, Conn.

[73] Assignee: Pitney Bowes Inc., Stamford, Conn.

[21] Appl. No.: 169,694

[22] Filed: Dec. 20, 1993

[51] Int. Cl.[6] ..... B41J 2/325

[52] U.S. Cl. ..... 400/120.01; 400/120.18; 400/240

[58] Field of Search ..... 400/120, 120.01, 120.18, 400/237, 240; 101/91; 346/1.1

[56] References Cited

U.S. PATENT DOCUMENTS

| | | | |
|---|---|---|---|
| 4,588,996 | 5/1986 | Ross et al. | 400/120 |
| 4,746,234 | 5/1988 | Harry | 101/91 |
| 4,836,697 | 6/1989 | Plotnick | 400/120 |
| 4,854,754 | 8/1989 | Miura et al. | 400/120 |
| 4,895,465 | 1/1990 | Mecke et al. . | |
| 5,099,256 | 3/1992 | Anderson | 346/1.1 |

FOREIGN PATENT DOCUMENTS 0189269 2/1992 European Pat. Off. .

*Primary Examiner*—Edgar S. Burr
*Assistant Examiner*—John S. Hilten
*Attorney, Agent, or Firm*—Ronald Reichman; Melvin J. Scolnick

[57] ABSTRACT

A postage dispensing apparatus that prints a postage indicia using a two step process. A thermal ribbon is provided which has pre-formed images on a major portion of the thermal ribbon. A blank area is provided on the thermal ribbon so that an image is generated by a dot matrix thermal printer on the blank portion on a mail piece. The pre-formed images represent non-variable portion of a postage indicia whereas the images formed by the thermal printer represent variable data of the postage indicia.

10 Claims, 1 Drawing Sheet

POSTAGE DISPENSING APPARATUS HAVING A THERMAL PRINTER AND METHOD OF USING THE SAME

BACKGROUND OF THE INVENTION

With the rapid advancements in the field of printing, newly developed printing techniques are being considered for use in the field of postage dispensing. Heretofore, postage dispensing apparatus, for the most part, have used mechanical components for the purpose of printing postage indicia upon mail pieces. In the recent past, electronic postage dispensing apparatus have been developed, but even these electronic apparatus relied upon mechanical printing components that were in communication with electronic accounting components. Needless to say, such postage dispensing apparatus are relatively expensive. Dot matrix printers have been developed and are commercially available such as ink jet printers and thermal printers.

Many publications have discussed and suggested the use of dot matrix printers in postage dispensing apparatus. In fact, recent changes in postal regulations allow mailers to use ink jet printers for printing certain non critical data on mail pieces. As a result, it appears to be a matter of time before postal regulations are changed to allow more extensive use of non-mechanical dot matrix printers. Of the contemporary printing techniques, the use of thermal printing for a postage dispensing apparatus appears attractive and has been disclosed in a number of articles and patents. The advantages offered by thermal printing is that of low cost and reliability. The one drawback to the use of a thermal printer is that it requires a relatively large and expensive printhead to print all the data required for a postage indicia. Clearly, it would be advantageous if one were able to use a thermal printer without the need of requiring a high amount of space and have the advantage of reduced cost.

SUMMARY OF THE INVENTION

A postage meter dispensing apparatus has been conceived that prints a postage indicia using a two step process. A thermal ribbon is provided which has pre-formed images on a major portion of the ribbon. These pre-formed images are of the fixed data on the indicia such as city, state, meter number and logo. Another portion of the ribbon has a blank area on which there is no pre-formed image and on which variable data, such as postage amount can be printed. Pressure rollers are provided whereby upon a mail piece being conveyed intermediate the ribbon and the pressure rollers, the pre-formed images are transferred to the mail piece. The pressure rollers have a groove that is in registration with the blank portion of the thermal ribbon so that the blank portion is not subjected to pressure. Downstream from the pressure rollers is a thermal printhead that prints data in the blank area. Of course, the data printed by the thermal printhead will be variable data; whereas that portion printed as a result of the pre-formed image and pressure is non-variable data. The thermal printhead is only one character high and thus does not require a great deal of space. With this combination, a postage indicia can be printed on a mail piece in an inexpensive and convenient manner.

BRIEF DESCRIPTION OF THE DRAWING

In the accompanying drawing, like numbers are used to indicate like parts in different figures and.

DETAILED DESCRIPTION OF THE PREFERRED EMBODIMENT

Figure 1:
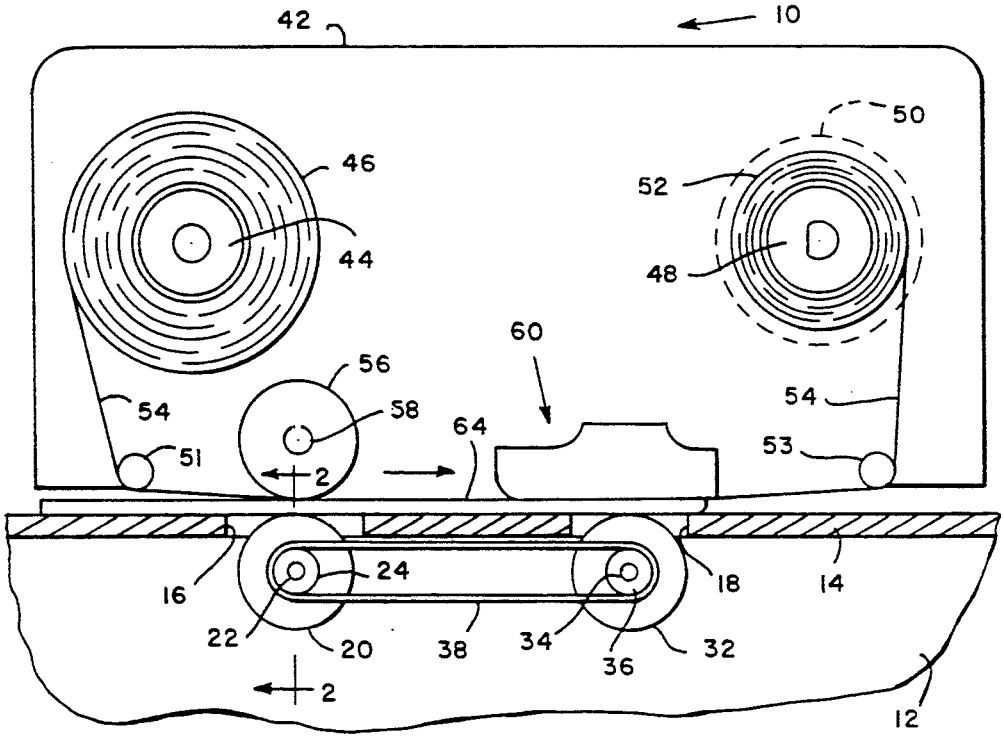
FIGS. 1 and 3 are a longitudinal, cross sectional view of a postage dispensing apparatus in which the instant invention can be practiced.
Figure 2:
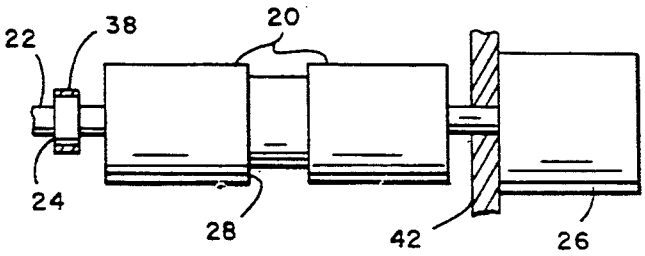
FIG. 2 is a longitudinal view of one of the rollers shown in FIG. 1 and taken along the lines 2—2.

With reference to FIGS. 1 and 2, a postage dispensing apparatus is shown generally at 10, that practices the instant invention. The postage dispensing apparatus 10 has a lower housing 12 with a longitudinally extending deck 14 at the upper portion thereof. The deck has a pair of lateral openings 16, 18. An impression roller 20 is received within the opening 16 and is mounted on a shaft 22, which shaft is supported by the lower housing 12. The shaft supports a pulley 24 on one end and is in engagement with a motor 26 at it's opposite end, the motor being supported within the housing 12. The roller 20 has a groove 28 about its periphery intermediate its ends.

Another roller 32 is received within the opening 18 and is rotatably supported within the housing by a shaft 34. The shaft 34 supports a pulley 36 that is in longitudinal alignment with the pulley 24. A belt 38 is trained about the pulleys 24, 36 to transfer the drive from the pulley 24 to the pulley 36.

The postage dispensing apparatus 10 has an upper housing 42 that supports a rotatable spindle 44 to which a supply reel 46 can be mounted. A motor 50 is supported by the upper housing 42 and is connected to a rotatable spindle 48, upon which a take-up reel 52 can be mounted. In this way, a pair of rollers 51, 53 are rotatably supported by the upper housing 42 and serve as a guide for a ribbon 54, such as a thermal ribbon, so that the ribbon can be conveyed across the deck 14 by being pulled by the take-up reel 52 and unwound from the supply reel 46.

An impression roller 56 is disposed upon a shaft 58 that is rotatably supported by the upper housing 42. Unlike the first roller 20, the second roller 56 does not have a groove therein. The roller 56 is in contact with the roller 20. These rollers are made of a resilient material, such as rubber, thereby allowing flat materials 64, such as a mail piece, to pass therethrough while applying pressure to such flat materials. Such pressure will transfer a pre-formed image from the ribbon 54 to the envelope 64. Alternatively, the roller 20 can be a heated rollers so that the fixed image is thermally transferred. Intermediate the roller 56 and the spindle 48, is a thermal printhead 60. This printhead is a one character high printhead as seen in FIG. 3 and contains a plurality of heating elements for printing on a flat such as a mail piece 64, when situated between the ribbon 54 and roller 32.

Figure 4:
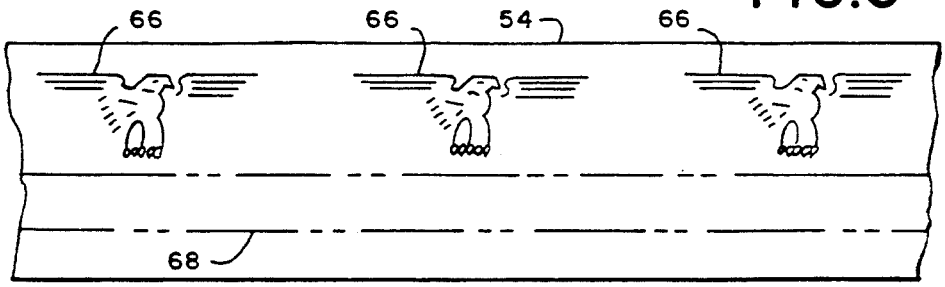
FIG. 4 is a plan view of a ribbon that incorporates features of the instant invention.

With reference now to FIG. 4, a ribbon 54 that is made in accordance with the instant invention is shown and has a pre-printed portion having pre-formed images 66 and a longitudinally extending blank potion 68. The pre-printed portion 66 can be applied by any convenient method such as silk screening so that upon contacting another surface the image will be transferred from the ribbon to such other surfaces. When the ribbon 54 is located within the postage dispensing apparatus 10, the blank portion 68 will be in registration with the groove 38 of the roller 20.

Figure 3:
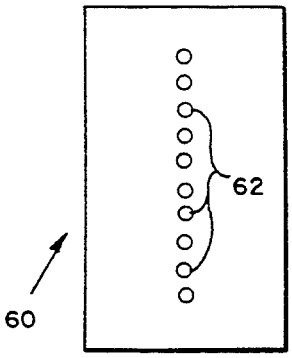

With reference to FIG. 3, the heating elements 62 of the thermal printer 60 are shown. Seven heating elements are shown and this represents the light of characters to be printed by the thermal printer 60 in a 5×7 dot character scheme.

In operation, a thermal ribbon 54 as that seen in FIG. 4, will be disposed about the reel 46 and the reel will be mounted on the spindle 44. The reel 50 is mounted on the spindle 48 and the ribbon threaded through the apparatus to the reel. The motor 50 will be enabled so as to drive the spindle 48 causing the ribbon 54 to be driven across the deck as indicated by the arrow in FIG. 1. Simultaneously with the conveyance of the ribbon 54 a mail piece in the form of a stuffed envelope 64 will be conveyed across the deck in synchronization with the ribbon 54. More specifically, the motor 26 will be in synchronization with the motor 50 so that the envelope 64 and ribbon 54 are driven synchronously. As the envelope 64 passes the impression rollers 20, 32, the pre-formed image 66 is transferred from the ribbon 54 to the envelope 64 to create an image thereon. The transfer of such image results from the pressure applied to envelope 64 as it is conveyed between the ribbon 54 and the rollers 20, 56. As stated previously, the image transfer could be accomplished thermally rather than through pressure. As the envelope passes the portion of the apparatus near the thermal printer 60, the thermal printer will be enabled so as to print the variable data at the location at the blank spot 68. The thermal printer will have postage accounting registers therein as is known in the art. Since such accounting registered do registered do not form part of the instant invention, they are not described. Thereafter, the envelope 64 is conveyed across the deck to be discharged from the postage dispensing apparatus 10.

Thus, what has been shown and described is an apparatus and method that uses a two step printing combination. The first step involves transferring fixed data from a thermal ribbon to an envelope, and the second step involves printing variable data on an envelope at a portion of the ribbon that does not contain pre-formed images. Because only a portion of the data is printed in a limited area, only a one character high printhead 60 is required.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A postage dispensing apparatus comprising:

a supply of thermal ribbon having pre-formed images and a ink coating thereon, a longitudinally extending deck, a pair of first laterally extending impression rollers in engagement with one another, said impression rollers being a means to transfer said pre-formed image, a motor connected with one of said laterally aligned pressure rollers, a second laterally extending roller located on said deck longitudinally spaced from said pair of first lateral extending rollers, a thermal printhead spaced relative to said second roller, said thermal printhead being a means to transfer part of said ink coating to form indicia, and means for conveying a thermal ribbon between said pair of laterally extending pressure rollers and between said printhead and said second roller.

2. The postage dispensing apparatus of claim 1 further including means for conveying a mail piece between said thermal ribbon and one of said rollers of said pair of impression and intermediate said printhead and second roller.

3. The postage dispensing apparatus of claim 1 wherein at least one of said rollers of said first pair of laterally extending impression rollers has a longitudinally extending groove intermediate the ends thereof.

4. The postage dispensing apparatus of claim 1 wherein said pre-formed images of said thermal ribbon is fixed postage indicia data.

5. A postage dispensing apparatus comprising:

a supply of thermal ribbon having pre-formed images and a ink coating thereon, a longitudinally extending deck having a pair of openings therein, a pair of first laterally extending impression rollers in engagement with one another to form a nip therebetween, one of said rollers of said pair of first rollers being received in one of said openings with the nip of said rollers being located along said deck, said impression rollers being a means to transfer said pre-formed image, a motor in connection with one of said first laterally extending impression rollers, a second roller received within the second opening of said deck longitudinally spaced from said laterally extending impression rollers, a thermal printhead spaced relative to said second roller, said thermal printhead being a means to transfer part of said ink coating to form indicia, and means for conveying a thermal ribbon between said pair of laterally extending impression rollers and between said printhead and said second roller.

6. The postage dispensing apparatus of claim 5 further including means for conveying a mail piece between said thermal ribbon and one of said rollers of said pair of impression rollers and intermediate said printhead and the other roller of said pair of impression rollers.

7. The postage dispensing apparatus of claim 5 wherein at least one of said rollers of said first pair of laterally extending rollers has a longitudinally extending groove intermediate the ends thereof.

8. The postage dispensing apparatus of claim 5 wherein further one of said rollers of said pair of rollers is a thermal roller.

9. The postage dispensing apparatus of claim 5 wherein said first pair of longitudinally extending rollers are impression rollers.

10. A method of dispensing postage, the steps comprising:

pre-forming images on a thermal ribbon and placing a longitudinal ink coating on said thermal ribbon, conveying the pre-formed image thermal ribbon between a pair of laterally extending impression rollers, conveying a mail piece between one of the laterally extending impression rollers and the pre-formed image thermal ribbon, conveying the mail piece and pre-formed ribbon between a thermal printhead and a roller said roller transferring the pre-formed image to said mail piece, and enabling the thermal printhead to create data on the mail piece from the coating.

* * * * *